US008306254B2

(12) United States Patent
Schmidt et al.

(10) Patent No.: US 8,306,254 B2
(45) Date of Patent: Nov. 6, 2012

(54) RECESSED AND ROTATABLE SPA SPEAKER SYSTEM

(75) Inventors: Darrell Schmidt, Simi Valley, CA (US); Francisco Hinojosa, Jr., Santa Paula, CA (US)

(73) Assignee: B & S Plastics, Inc., Oxnard, CA (US)

( * ) Notice: Subject to any disclaimer, the term of this patent is extended or adjusted under 35 U.S.C. 154(b) by 1327 days.

(21) Appl. No.: 11/786,270

(22) Filed: Apr. 10, 2007
(Under 37 CFR 1.47)

(65) Prior Publication Data

US 2010/0046785 A1 Feb. 25, 2010

Related U.S. Application Data

(60) Provisional application No. 60/791,041, filed on Apr. 10, 2006.

(51) Int. Cl.
*H04R 1/02* (2006.01)

(52) U.S. Cl. ..... 381/387; 381/386; 381/395; 381/189

(58) Field of Classification Search ..... 381/336, 381/386–387, 395, 426, 189; 181/150; 362/364–366, 372
See application file for complete search history.

(56) References Cited

U.S. PATENT DOCUMENTS

| | | | | | |
|---|---|---|---|---|---|
| 3,719,250 | A * | 3/1973 | Maekawa | 181/153 |
| 4,575,882 | A * | 3/1986 | Diamond | 4/559 |
| 4,965,837 | A * | 10/1990 | Murayama et al. | 381/186 |
| 5,321,760 | A | 6/1994 | Gray | 181/150 |
| 5,516,070 | A | 5/1996 | Chapman | 248/404 |
| 6,243,260 | B1 | 6/2001 | Lundgren et al. | 361/683 |
| 6,427,258 | B1 | 8/2002 | Gooley | 4/566.1 |
| 6,608,909 | B2 | 8/2003 | Brady | 381/387 |
| 6,763,532 | B2 * | 7/2004 | Gardenier et al. | 4/541.1 |
| 6,925,190 | B2 * | 8/2005 | Popken et al. | 381/395 |
| 7,055,186 | B2 | 6/2006 | Lauter et al. | 4/541.1 |
| 7,077,236 | B2 * | 7/2006 | Sleboda et al. | 181/150 |
| 7,100,879 | B2 | 9/2006 | Podue et al. | 248/220.31 |
| 7,570,778 | B2 * | 8/2009 | Wright | 381/387 |
| 7,668,332 | B2 * | 2/2010 | Williams et al. | 381/386 |
| 7,840,021 | B2 * | 11/2010 | Greco et al. | 381/334 |
| 8,014,554 | B2 * | 9/2011 | Xu et al. | 381/386 |
| 2004/0156517 | A1 | 8/2004 | Schmidt et al. | |

OTHER PUBLICATIONS

Sugatsune, D Latches/Catches, Lamp pp. 82.
Sdp Inch, Neg'Ator Constant Force Springs, 9 Miscellaneous Components, p. 9-42.

* cited by examiner

*Primary Examiner* — Curtis Kuntz
*Assistant Examiner* — Ryan Robinson
(74) *Attorney, Agent, or Firm* — Koppel, Patrick, Heybl & Philpott

(57) ABSTRACT

A spa speaker system having a housing with a speaker mounted therein, wherein the housing is mounted within a hole in the wall of a spa. The speaker system is arranged at an angle within the housing, and is rotatable with respect to the hole. The system can also comprise a watertight membrane arranged to prevent water and contaminants from interfering with speaker components. A system for providing audio to a spa is also disclosed. The system comprises a spa having walls and at least one speaker unit mounted in a spa wall. Each of the speaker units is capable of receiving an audio signal, and generating sound towards the occupants of the spa. Each of the speaker units comprises a speaker that is individually rotatable and arranged at an angle to direct the sound.

32 Claims, 4 Drawing Sheets

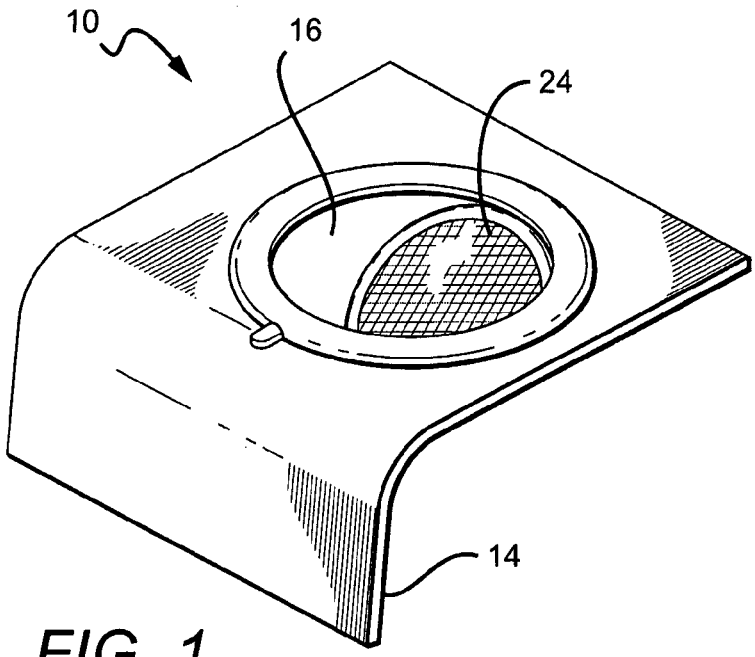
FIG. 1
FIG. 3
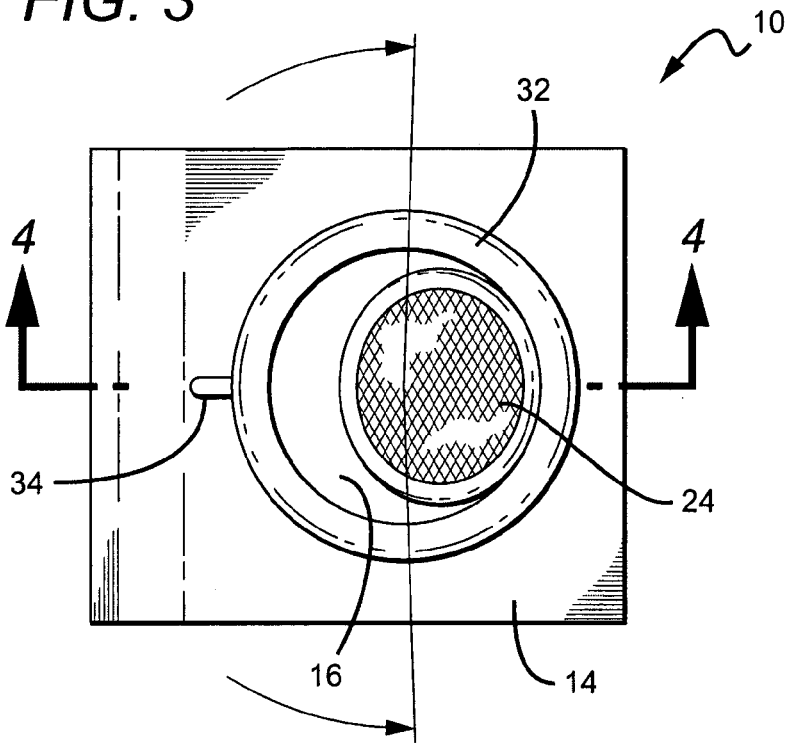

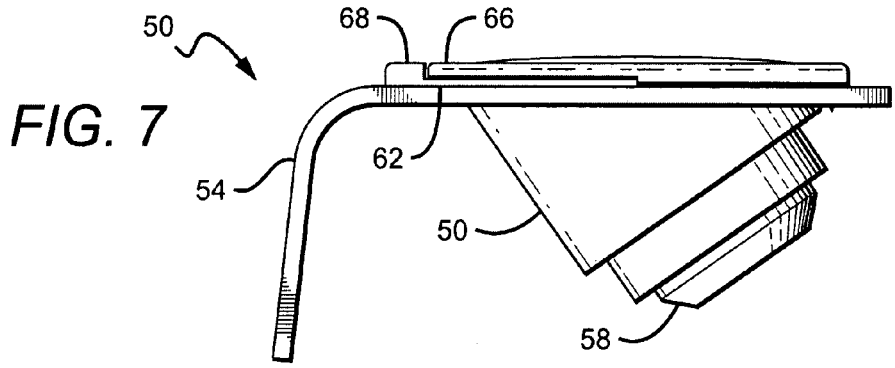
FIG. 7
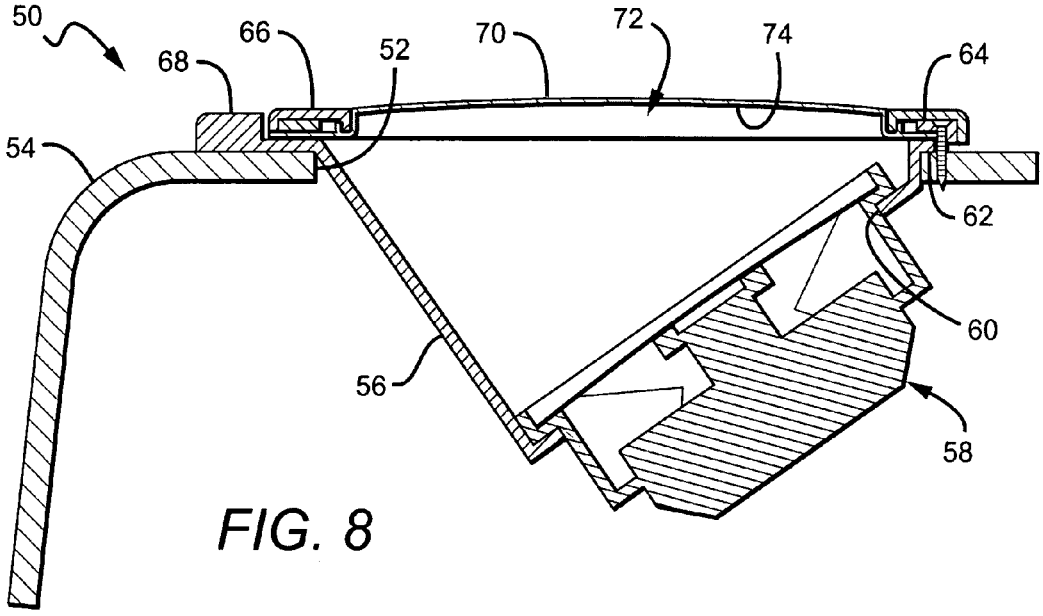
FIG. 8
FIG. 9
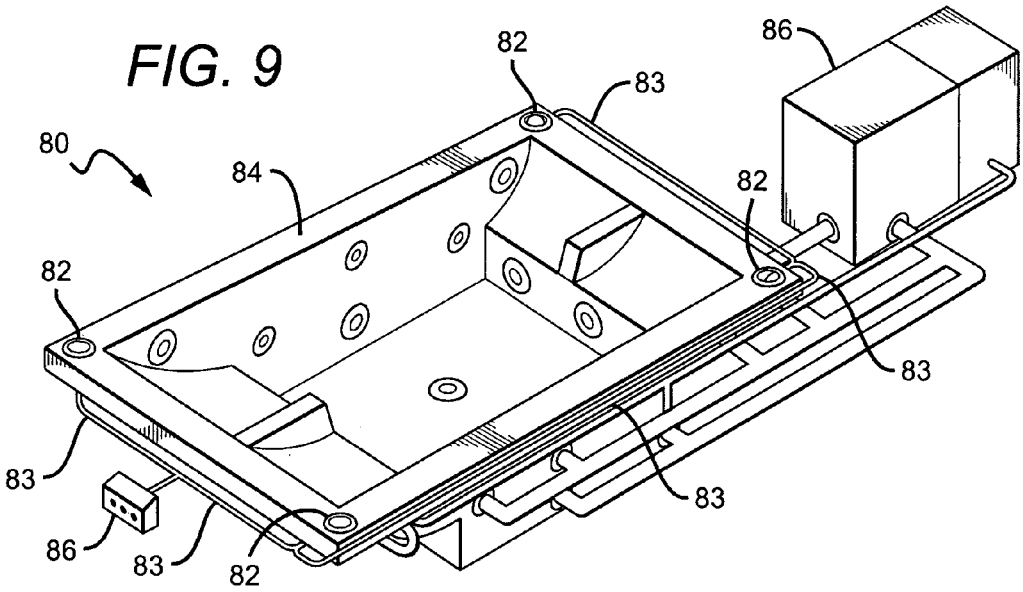

RECESSED AND ROTATABLE SPA SPEAKER SYSTEM

This application claims the benefit of provisional application Ser. No. 60/791,041 to Schmidt et al., which was filed on Apr. 10, 2006.

BACKGROUND OF THE INVENTION

1. Field of the Invention

This invention relates to speaker systems, and more particularly to speaker systems used in spas and recess mounted in a spa wall.

2. Description of the Related Art

Recreational or therapeutic reservoirs of water such as pools, spas, bathtubs and the like (collectively referred to as "spas" or "spa") are more commonly being constructed with features such as televisions and audio systems. For the occupants of the spa to hear the television or audio system, a number of speakers can be included around the spa, with a common location for the speakers being the edge of the spa above the waterline. The speakers are arranged so that the sound they produce is directed toward the spa occupants and can be heard over the noise of the spa's plumbing system.

One conventional way of mounting speaker systems around the edge of spas having Acrylic or fiberglass spa bodies is to form "ears" or extensions in the spa body and to mount a respective speaker in each of the ears. The ears may be formed during the spa fabrication process to provide fixed and permanent housings for the speakers. The ears are usually arranged around the edge of the spa and extend above the edge, with a typical location being in the corners of a rectangular or square spa. When the speakers are installed in the ears, their sound is directed in toward the spa occupants. One example of these ears may be purchased in the Excalibur series spas available from Dynasty Spas of Athens, Tenn.

Other spa speaker systems have been developed with speaker housings that extend from the top edge of the spa during use and can then be retracted below the edge when not in use. Holes are formed in the surface of the spa shell around the edge of the spa and the speakers are mounted within the holes. When the speaker housings are fully retracted, their top surfaces are substantially flush with the surface of the spa. The speaker housings may be restored to their non-retracted operating position with the force of an air pump/cylinder, hydraulic system or electric hoist, all of which are usually housed behind the wall of the spa body and push the speakers up from the bottom. The speakers may be connected to a common air or hydraulic driving system so that the air or hydraulic extenders may be simultaneously actuated to simultaneously extend the speaker housings. One example of such a system may be purchased from Cal Spas of Pomona, Calif.

In these types of speaker systems each speaker can require its own air, hydraulic or electronic actuator, and at least one actuator driving system. The actuators and their driving systems can add significant cost and complexity. The space behind the wall of a spa is also often at a premium, particularly for portable spas. The plumbing and electrical systems consume much of the space behind the spa wall, leaving little space for speakers. Speaker systems with air, hydraulic or electrical actuators can consume precious space behind the spa wall.

Conventional spa speaker systems also produce a fixed sound pattern that can vary from location to location within the spa, producing a good audio experience for some of the spa occupants but a poor one for others. Furthermore, when an occupant changes his or her location within the spa the sound quality can also change, forcing him or her to choose between a desired spot in the spa and a desired sound quality.

SUMMARY OF THE INVENTION

Briefly, and in general terms, the present invention seeks to provide a spa speaker system that consumes less space behind the wall of a spa, is less complex and less costly. The invention also seeks to provide a speaker system that is relatively easy to install and use, with each individual speaker unit being easily rotated and angled to customize sound direction.

One embodiment of a spa speaker according to the present invention comprises a spa speaker having a housing with the speaker mounted therein. The housing is mounted within a hole in the wall of a spa, with the majority of the housing arranged below the topmost surface of the wall. The speaker system is rotatable relative to the hole, allowing spa occupants to control the direction of the sound. Further, the speaker may be covered by a membrane to protect the speaker from water and other contaminants One embodiment for providing audio to a reservoir of water according to the invention comprises a reservoir having a wall and at least one speaker system mounted in the wall. The system also comprises at least one speaker system, each with a housing having a speaker mounted therein. The housing is mounted within a hole in the wall of a reservoir, with the majority of the housing arranged below the topmost surface of the wall. Each speaker system is rotatable relative to its hole, allowing spa occupants to control the direction of the sound of each speaker system. Each of the speaker systems is capable of receiving an audio signal either electronically or wirelessly.

These and further features and advantages of the invention will be apparent to those skilled in the art from the following detailed description and the accompanying drawings, which illustrate by way of example the features of the invention.

BRIEF DESCRIPTION OF THE DRAWINGS

FIG. 1 is a perspective view of one embodiment of a spa speaker system according to the present invention;

FIG. 3 is a plan view of the spa speaker system shown in FIG. 1;

FIG. 7 is a side view of the spa speaker system shown in FIG. 6;

FIG. 8 is a sectional view of the spa speaker system shown in FIG. 6, taken along section lines 8-8; and FIG. 9 is a perspective view of one embodiment of a spa according to the present invention having a plurality of spa speaker systems according to the present invention.

DETAILED DESCRIPTION OF THE INVENTION

The present invention relates generally to speakers arranged in a spa, pool, hot tub, or indoor spa tub ("spa") that provides audio to the spa occupants. The spa speaker system comprises a speaker housing that is mounted in a hole in the spa wall, with a speaker arranged to project sound to the spa occupants. In one embodiment this is accomplished by arranging the speaker housing in a hole in the spa wall, with the majority of the spa speaker behind or below the spa wall. The spa speaker can be arranged at an angle within the speaker housing, with a suitable angle being approximately 45 degrees. It is understood, however, that the speaker can be held at many other angles. In some embodiments the angle of the speaker can be adjusted. The spa speaker system can also include a membrane that can be arranged in many different ways to protect the speaker from liquids or other contaminants, and in particular from spa water. In some embodiments, the spa has a membrane covering the speaker, with the membrane made of a material to protect the speaker while not interfering with the sound it produces. In some embodiments the membrane has a watertight seal over the speaker to protect it. A drainage hole can be included to allow liquids and other contaminants to pass out of the spa speaker system. In other embodiments, the membrane can be arranged to cover the spa wall hole to protect the spa speaker.

It is understood that spa speaker systems according to the present invention can also be located either partially or fully below the waterline. In these embodiments the membrane forms a watertight seal to prevent water from interfering with or damaging the speaker. In the above or below water speakers, the membrane can be arranged to form a watertight seal over the front of the speaker or over the spa hole.

Figure 2:
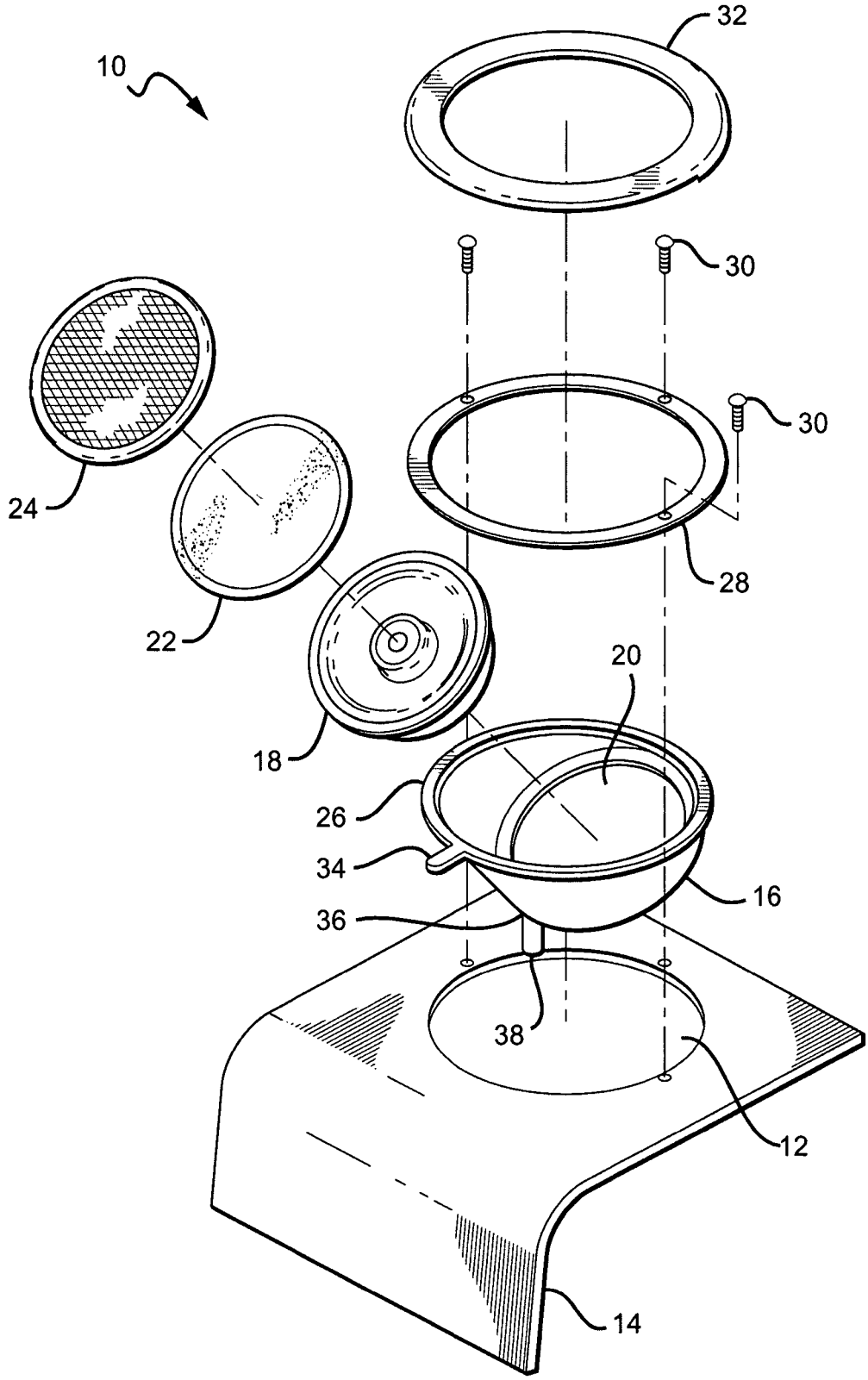
FIG. 2 is an exploded view of the spa speaker system shown in FIG. 1.
Figure 4:
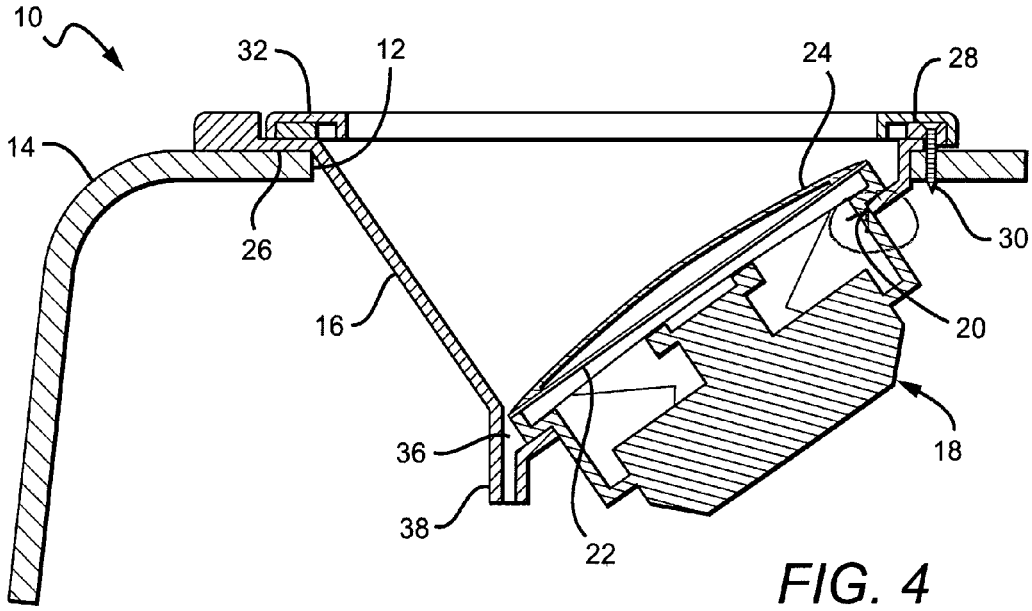
FIG. 4 is a sectional view of the spa speaker system in FIG. 1, taken along section lines 4-4 in FIG. 2.

FIGS. 1-4 show one embodiment of a spa speaker system 10 according to the present invention. A spa hole 12 (shown best in FIGS. 3 and 4) is formed in the spa shell through the spa wall 14, with the hole 12 having the appropriate size to hold speaker housing 16. The spa hole 12 can be formed in many different locations on the spa wall 14, but is preferably formed in a horizontal surface above the spa's waterline.

The speaker system 10 further comprises a speaker 18 (shown best in FIGS. 3 and 4) mounted within the speaker housing 16 at an angle to project sound to the spa occupants, such as at an approximately 45 degree angle. The speaker 18 can be fixedly mounted at an angle or can be movably mounted so that the angle can be adjusted within the speaker housing 16. Different speakers can be used such as conventional indoor speakers, outdoor speakers, or marine rated speakers. The speaker 18 can be mounted within the housing in many different arrangements, with the speaker 18 preferably mounted within a speaker housing opening 20. The speaker 18 is held within the opening using conventional methods, such as by screws, and a sealant (not shown) can be included between the speaker 18 and the speaker housing 16, around the opening 20. The sealant provides a watertight seal between the speaker 18 and the housing 16, with suitable sealants being silicones and epoxies, or sealing devices such as O-rings or gaskets. Most of the speaker 18 is below the opening 20 which allows for convenient electrical connection during installation.

The speaker system further comprises a membrane 22 covering the front of the speaker 18, with the membrane being thick and robust enough to protect the speaker 18 from liquid and contaminants, while at the same time being thin and flexible enough to allow sound from the speaker 18 to pass. The membrane 22 can be made of many different materials of different thickness, with a preferred material being a thin Mylar sheathe. The membrane 22 should be mounted over the front of the speaker 18 with a watertight seal between the two. This can be accomplished using different adhesives, such as glues or epoxies. Alternatively, the speaker system 10 can comprise a speaker cover 24 sized to fit over and be mounted to the front of the speaker 18. The outside edge of the membrane 22 can be sandwiched between the outside edge of the speaker cover 24 and the outside edge of the speaker 18 to mount the membrane with a watertight seal. In still other embodiments, the membrane can be formed as part of an injection molded plastic ring. The ring should be sized to be sandwiched between the edge of the speaker cover 24 and the edge of the speaker front to form a watertight seal. The speaker cover 24 further comprises holes to allow sound to pass from the speaker 18 through the speaker cover 24.

The speaker system 10 can also be rotatable to allow for the spa occupants to adjust the direction that the speakers project. The spa speaker system 10 can be mounted to the spa hole in many different ways using different mechanisms. In the embodiment shown, the speaker housing 16 had a radial lip 26 around its upper edge, with the lip 26 having a larger diameter than the spa hole 12. This arrangement allows the speaker housing 16 to rest in spa hole 12, with the lip 26 on the spa wall 14. A set ring 28 is mounted over the lip 26 and to the spa wall, preferably by mounting screws 30 that pass into the spa wall outside the lip 26. The trim ring 32 can be included for aesthetics, to cover the set ring 28 and the mounting screws 30.

The speaker housing 16 can be rotated under the set ring 28 and trim ring 32, with the set ring holding the speaker housing 16 in the spa hole 12. The lip 26 can have a rotation finger 34 that can be moved to move the speaker housing. Both the set ring 28 and trim ring 32 are divided into front and back portions. The front portion of both provide a space between them and the spa wall 14, to allow the finger 34 to pass under when rotating the speaker housing. The back portion of both extends down so that there is no space between them and the spa wall 14. This allows for the set ring 28 to be firmly mounted to the spa wall, and also provides a blocking point to prevent the finger 34 from being rotated too far in either direction. The set ring 28 and trim ring 32 can be arranged to allow different rotation ranges for the finger 34, with a suitable range being approximately 180 degrees. When the finger 34 is rotated, the speaker housing 16 and its speaker 18 are also rotated for controlling the direction of speaker sound projection. It is understood, however, that speaker systems according to the present invention can also be arranged to have a smaller range of rotation or to have a range of rotation beyond 180 degrees. For the larger ranges of motion, the systems allow the speaker housing to be rotated to project sound in a direction outside of the spa.

It is understood that the finger 34 can have different shapes and sizes and can be located on other parts of the spa speaker system. Spa speaker systems according to the present invention can also have other features that allow for rotation by the spa occupants. One of these alternative features comprises scallops on the spa housing that allow spa occupants to grasp the spa housing and turn it.

The speaker system 10, further comprises a drainage hole 36 that can be in different locations, but is preferably at the base of the speaker housing 16. The drainage hole 36 allows liquids and other contaminants to drain or fall out of the speaker housing 16. The drainage hole 36 can also be arranged with an extension 38 away from the housing which allows for a conduit (not shown) to be attached. The conduit can direct the liquids or contaminants to a desired deposit location, such as an outside drain. For speaker systems that are submerged, drainage holes are not necessary.

In operation, the speaker 18 in each speaker system 10 can be electrically connected to sound generating systems such as radios, televisions, DVD players, cassette players, MP3 players, etc. This electrical connection causes the speaker to generate sound in response to the signal provided at the connection. The sound is projected toward the spa occupants in a direction dependant upon the rotation orientation of the speaker housing 16. When water or other contaminants enter the speaker housing 16, and in particular spa water, the speaker is protected by the membrane 22 so that the speaker continues to project sound and is not muffled by the water. The liquid/contaminants run out of the spa housing 16, through the drainage hole 36. The membrane also vibrates in response to the speaker vibrations, which can cause remaining droplets of water or contaminants to jump off the membrane, to preferably pass through the drainage hole.

Figure 5:
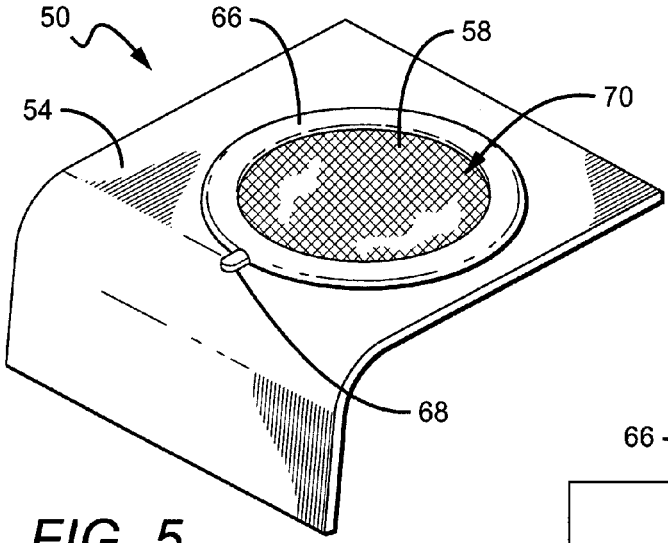
FIG. 5 is a perspective view of another embodiment of a spa speaker system according to the present invention.
Figure 6:
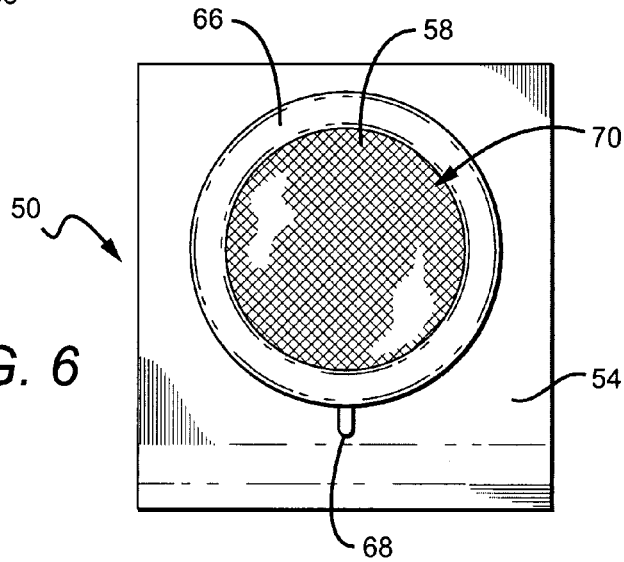
FIG. 6 is a plan view of the spa speaker system shown in FIG. 5.

FIGS. 5-8 show another embodiment of a speaker system 50 according to the present invention that is arranged similar to the system 10 in FIGS. 1-4. It comprises a similar spa hole 52 in the spa wall 54. A speaker housing 56 is rotatably held in the spa hole 52 with a speaker 58 held at an angle within an opening 60 in the housing 56. The speaker housing has a lip 62 resting on the spa wall 54, with a set ring 64 holding the lip 62 in place (best shown in FIGS. 7 and 8). A trim ring 66 can also be included over set ring 64, with the set ring and trim ring 66 having front and back portions arranged to limit the rotation of the speaker housing 56. The lip 62 also has a rotation finger 68 to allow the spa occupants to control the projection direction of the speaker 58 by moving the rotation finger 68.

The system 50, however, has a spa hole cover 70 instead of a speaker cover. As best shown in FIG. 8, the spa hole cover 70 has a diameter larger than the top spa housing opening 72, and is held in place by being sandwiched between the trim ring 66 and the edge of the top spa housing opening 72. A membrane 74 is arranged over the top spa housing opening 72 either extending across the opening 72 or by having it affixed to the backside of the spa hole cover 70. The membrane 74 can be made of many different materials similar to those for member 22 in system 10, with a suitable material being a Mylar sheathe. The spa hole cover 70 has holes to allow sound to pass through from the speaker 58. The membrane 74 prevents liquids and other contaminants from entering the spa speaker housing 56 through the spa hole cover. Because the membrane prevents all or most liquids and contaminants from entering the speaker housing 56, no drainage hole is needed.

The speaker system 50 operates in much the same way as speaker system 10, and is electrically connected to a sound generating system. The speaker housing 56 can be rotated to control the direction of the speakers by moving rotation finger 68.

The components for speaker systems 10 and 50 can be formed using known methods and can be formed of known materials. For example, the components other that the membrane and speaker can be formed from a water impervious plastic such as ABS, PVC or CPVC and can be fabricated using standard injection molding techniques. The speaker system uses commercially available speakers, and the membrane can be made of the materials mentioned above and can be arranged within the speaker system as described above.

Speakers according to the present invention provide a number of advantages. By using the speaker arrangement, the spa shell does not need specially formed ears or extensions to hold the speakers. Instead, speakers according to the present invention can be installed in the spa wall of most conventional spas. In operation, the speaker system is below the spa wall, which can help avoid damage to the spa speaker system. The speaker systems do not extend from the spa wall such that there are no extension mechanisms that can add cost and complexity. The holes in the spa wall can be formed using conventional cutting methods, and the holes can be formed at different steps in the spa manufacturing process. For example, in custom spas the holes can be formed late in the manufacturing process to allow for customer preferences. The invention also allows for the same spas shells to be used for spas not having sound systems and those that do, which can simplify the manufacturing process and can reduce cost.

FIG. 9 is a perspective view of a spa 80 with a number of speaker systems 82 according to the present invention, each of which is arranged on horizontal surface 84 that runs around the edge of spa 80 that is above the waterline. Each speaker system 82 comprises a hole in surface 84 sized to accept the speaker housing of each speaker system 82. It is understood that speaker systems 82 according to the present invention may also be arranged at different locations and can be included in other reservoirs of water such as pools, hot tubs or bathtubs.

Spa 80 also comprises a plumbing system 86 that can include pumps, filters and conduits. An audio system 86 generates an audio signal to be transmitted to each of the speaker systems 82, such as over speaker cable 83. As discussed above, the audio system may be any apparatus that generates an audio signal including but not limited to television, compact disc player, receiver, cassette player, DVD player, MP3 player, etc. In other embodiments according to the present invention, the connection between audio system 86 and each of the speaker systems 82 can be wireless. Each of the speaker systems 82 can contain a wireless receiver that allows access to wireless transmissions, and converts the accessed transmission into sound to be directed into spa 80. Audio system can include a transmitter for generating wireless transmission for broadcast to the speaker systems 82. Audio system can be attached to spa 80, or can be positioned near the spa as long as speaker systems 82 are within effective broadcast range of audio system's wireless transmission.

Although the present invention has been described in considerable detail with reference to certain preferred configurations, other versions are possible. Different components may be used in speaker systems according to the invention and the speaker system components may be arranged in different ways. Therefore, the spirit and scope of the appended claims should not be limited to the preferred version as described above.

We claim:

1. A spa speaker system, comprising:

a hole in the wall of a spa;

a housing, said housing mounted in said hole, the majority of said housing arranged behind the surface of said wall;

a speaker mounted within said housing; and a membrane covering said speaker wherein said housing has a radial lip around its upper edge which has a larger diameter than said hole and abuts said wall, said housing lip including a rotation finger that can movably rotate the housing about an axis perpendicular to the surface of said wall.

2. The speaker system of claim 1, wherein said membrane protects said speaker from liquid and contaminants.

3. The speaker system of claim 2, wherein said speaker is arranged at an angle within said housing so as to project sound to the spa occupants.

4. The speaker system of claim 3, wherein the angle of said speaker can be adjusted.

5. The speaker system of claim 2, wherein said membrane forms a watertight seal.

6. The speaker system of claim 5, wherein said membrane allows sound from said speaker to pass through it.

7. A spa speaker system, comprising:

a hole in the wall of a spa;

a housing, said housing mounted in said hole, the majority of said housing arranged behind the surface of said wall, said housing having a radial lip around its upper edge, said lip abutting said wall, said lip having a larger diameter than said hole, said lip having a rotation finger that can movably rotate the housing;

a speaker mounted within said housing;

a mechanism enabling said housing to rotate, said mechanism comprising a rotation finger; and a membrane covering said speaker; and a set ring mounted over said lip, said set ring holding said housing in said hole while allowing said housing to rotate under it.

8. The speaker system of claim 7, wherein a trim ring can be included to aesthetically cover said set ring, said trim ring containing an extended portion that abuts said spa wall, blocking said finger from full 360 degree rotation.

9. The speaker system of claim 7, wherein said set ring contains an extended portion that abuts said spa wall, blocking said finger from full 360 degree rotation.

10. The speaker system of claim 1, wherein said housing contains a drainage hole to allow liquids and other contaminants to pass through said housing.

11. The speaker system of claim 1, wherein said speaker can be electrically connected to a sound generating system.

12. The speaker system of claim 1, wherein said speaker can receive wireless transmissions from a sound generating system.

13. A spa speaker system, comprising:

a hole in the wall of a spa;

a housing, said housing mounted in said hole, the majority of said housing arranged below the topmost surface of said wall; and a speaker mounted within said housing;

wherein said housing has a radial lip around its upper edge which has a larger diameter than said hole and abuts said wall, said housing lip including a rotation finger that can movably rotate the housing about an axis perpendicular to the surface of said wall.

14. The speaker system of claim 13, wherein said speaker is arranged at an angle within said housing so as to project sound to the spa occupants.

15. The speaker system of claim 14, wherein the angle of said speaker can be adjusted.

16. The speaker system of claim 13, wherein said system comprises a membrane, said membrane covering said speaker system.

17. The speaker system of claim 16, wherein said membrane protects said speaker from liquid and contaminants.

18. The speaker system of claim 17, wherein said membrane forms a watertight seal.

19. The speaker system of claim 13, wherein said housing lip has a rotation finger that can movably rotate the housing.

20. The speaker system of claim 13, wherein said speaker can be electrically connected to a sound generating system.

21. The speaker system of claim 13, wherein said speaker can receive wireless transmissions from a sound generating system.

22. A system for providing sound to a reservoir of water, comprising:

a reservoir shell capable of holding water; and at least one speaker system mounted to the reservoir shell, wherein said speaker system comprises:

a hole in the wall of said reservoir shell;

a housing, said housing mounted in said hole, the majority of said housing arranged below the topmost surface of said wall; and a speaker mounted within said housing;

wherein said housing has a radial lip around its upper edge which has a larger diameter than said hole and abuts said wall, said housing lip including a rotation finger that can movably rotate the housing about an axis perpendicular to the surface of said wall.

23. The system of claim 22, wherein said speaker system is at least partially covered by a membrane.

24. The system of claim 23, wherein said membrane protects said speaker from liquid and contaminants.

25. The system of claim 22, wherein said speaker is arranged at an angle within said housing so as to project sound to the reservoir occupants.

26. The system of claim 25, wherein the angle of said speaker can be adjusted.

27. The system of claim 23, wherein said membrane forms a watertight seal.

28. The system of claim 27, wherein said membrane allows sound from said speaker to pass through it.

29. The system of claim 22, wherein said speaker system can be electrically connected to a sound generating system.

30. The system of claim 22, wherein said speaker system can receive wireless transmissions from a sound generating system.

31. A spa speaker system, comprising:

a hole in the wall of a spa;

a housing mounted in said hole, the majority of said housing arranged behind the surface of said wall; and a speaker mounted within said housing;

wherein said housing has a radial lip around its upper edge which has a larger diameter than said hole and abuts said wall, said housing lip including a rotation finger that can movably rotate the housing about an axis perpendicular to the surface of said wall.

32. The system of claim 31, further comprising a membrane covering said speaker.

* * * * *